US012773040B2

(12) United States Patent
Wainless et al.

(10) Patent No.: US 12,773,040 B2
(45) Date of Patent: Oct. 27, 2026

(54) PERSONAL CARE IMPLEMENT

(71) Applicant: Colgate-Palmolive Company, New York, NY (US)

(72) Inventors: Daniel Wainless, New Brunswick, NJ (US); Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 445 days.

(21) Appl. No.: 18/482,402

(22) Filed: Oct. 6, 2023

(65) Prior Publication Data

US 2024/0122335 A1 Apr. 18, 2024

Related U.S. Application Data

(60) Provisional application No. 63/415,737, filed on Oct. 13, 2022.

(51) Int. Cl.
*A46B 5/02* (2006.01)
*A46B 9/04* (2006.01)

(52) U.S. Cl.
CPC ..... *A46B 5/026* (2013.01); *A46B 5/021* (2013.01); *A46B 9/04* (2013.01); *A46B 2200/1066* (2013.01)

(58) Field of Classification Search
CPC ..... A46B 5/026; A46B 5/021; A46B 5/028
See application file for complete search history.

(56) References Cited

U.S. PATENT DOCUMENTS 5,398,369 A 3/1995 Heinzelman et al.
6,298,516 B1 * 10/2001 Beals ..... A46B 5/026 15/167.1
6,353,958 B2 3/2002 Weihrauch
7,047,591 B2 5/2006 Hohlbein
7,143,462 B2 12/2006 Hohlbein
(Continued)

FOREIGN PATENT DOCUMENTS

CN 204105196 1/2015
DE 102006005616 8/2007
(Continued)

OTHER PUBLICATIONS

International Search Report and the Written Opinion of the International Searching Authority issued in International Application PCT/US2023/076208 mailed Feb. 26, 2024.

*Primary Examiner* — Shay Karls

(57) ABSTRACT

A personal care implement having a handle which includes a first rigid portion, a second rigid portion, and an elastomeric portion located therebetween. The first and second rigid portions may have end portion with first and second tabs. The elastomeric portion has a front surface, a rear surface, and a peripheral surface that extends between the front and rear surfaces. A first groove may be formed between the first tab of the first rigid portion and the first tab of the second rigid portion. A second groove may be formed between the second tab of the first rigid portion and the second tab of the second rigid portion. A first portion of the peripheral surface of the elastomeric portion may form a floor of the first groove and a second portion of the peripheral surface of the elastomeric portion may form a floor of the second groove.

19 Claims, 12 Drawing Sheets

(56) References Cited

U.S. PATENT DOCUMENTS

| | | | | |
|---|---|---|---|---|
| 8,448,284 | B2 | 5/2013 | Gross et al. | |
| 8,990,995 | B2 * | 3/2015 | Jimenez | A46B 5/026 15/167.1 |
| 9,737,134 | B2 | 8/2017 | Moskovich et al. | |
| 2010/0313371 | A1 | 12/2010 | Kaczmarek | |
| 2011/0167579 | A1 | 7/2011 | Huber et al. | |
| 2021/0161283 | A1 | 6/2021 | Hohlbein et al. | |

FOREIGN PATENT DOCUMENTS

| | | |
|---|---|---|
| EP | 3903634 | 11/2021 |
| WO | 2000/64306 | 11/2000 |

* cited by examiner

PERSONAL CARE IMPLEMENT

CROSS-REFERENCE TO RELATED APPLICATIONS

The present application claims the benefit of priority to U.S. Provisional Patent Application Ser. No. 63/415,737, filed Oct. 13, 2022, the entirety of which is incorporated herein by reference.

BACKGROUND

Personal care implements such as toothbrushes are commonly formed from plastic. It is now well established that plastic pollution is one of the most pressing environmental issues that must be addressed. Plastic does not decompose, and therefore all plastic that has ever been produced is still present in one form or another. While recycling has made a small impact on the reduction of plastics in landfills and oceans, there remains far too much plastic in the products used by consumers in everyday life. Furthermore, plastic is made from materials that include coal, salt, crude oil, and toxic materials such as benzene and vinyl hydrochloride. Many good s manufacturers are therefore working to reduce their plastic output to reduce the amount of plastic sitting in landfills and oceans. The invention described herein seeks to address these issues by reducing the amount of plastic in oral care implements such as toothbrushes without negatively affecting consumer enjoyment during use of the same.

BRIEF SUMMARY

The present invention is directed to an oral care implement that uses less plastic by removing material from a handle of the oral care implement while maintaining a comfortable grip which is similar to a normal grip that a user associates with an oral care implement. That is, the handle has grooves in a peripheral surface formed between plastic members such that the handle or a portion thereof utilizes less plastic than traditional toothbrushes. The grooves serve as a functional feature which enhances a user's ability to handle and manipulate the implement during use. Portions of the handle may be covered with an elastomeric material to increase gripability and comfort.

In one aspect, the invention may be a personal care implement comprising: a handle comprising a first rigid portion, a second rigid portion, and an elastomeric portion located between the first and second rigid portions; the first rigid portion comprising a first end portion comprising a first tab and a second tab; the second rigid portion comprising a second end portion comprising a first tab and a second tab; the elastomeric portion comprising a front surface, a rear surface, and a peripheral surface that extends between the front and rear surfaces; wherein a first groove is formed between the first tab of the first rigid portion and the first tab of the second rigid portion and a second groove is formed between the second tab of the first rigid portion and the second tab of the second rigid portion, a first portion of the peripheral surface of the elastomeric portion forming a floor of the first groove and a second portion of the peripheral surface of the elastomeric portion forming a floor of the second groove.

In another aspect, the invention may be a personal care implement comprising: a handle comprising a first rigid portion, a second rigid portion, and an elastomeric portion located between the first and second rigid portions, the elastomeric portion forming a thumb grip comprising a front surface, a rear surface, and a peripheral surface that extends between the front and rear surfaces; the first rigid portion comprising a first end portion that is adjacent to a top portion of the thumb grip, the first end portion comprising a first tab and a second tab; the second rigid portion comprising a second end portion that is adjacent to a bottom portion of the thumb grip, the second end portion comprising a first tab and a second tab; wherein the first and second tabs of each of the first and second rigid portions comprises an exposed outer surface; and wherein a portion of the peripheral surface of the thumb grip is recessed relative to the exposed outer surface of the first and second tabs of each of the first and second rigid portions.

In another aspect, the invention may be a personal care implement comprising: a rigid component comprising: a first portion extending from a first end to a second end, the first portion forming a neck portion and a head portion of the oral care implement; a second portion extending from a first end to a second end, the second portion forming a gripping portion of the oral care implement; and a core extending between the first end of the first portion and the first end of the second portion, the core comprising an inner surface that defines a through hole; a resilient component comprising an elastomeric body that forms a thumb grip of the oral care implement; and wherein the core of the rigid component is embedded within the elastomeric body so that no portion of the core of the rigid component is exposed and the elastomeric body fills the through hole of the core.

In yet another aspect, the invention may be a personal care implement comprising: a handle comprising a first rigid portion, a second rigid portion, and an elastomeric portion located between the first and second rigid portions, the handle extending along a longitudinal axis; the first rigid portion comprising a first end portion; the second rigid portion comprising a second end portion; the elastomeric portion comprising a front surface, a rear surface, and a peripheral surface that extends between the front and rear surfaces; wherein a first groove is formed between the first end portion of the first rigid portion and the second end portion of the second rigid portion on a first side of the longitudinal axis and a second groove is formed between the first end portion of the first rigid portion and the second end portion of the second rigid portion on a second side of the longitudinal axis, a first portion of the peripheral surface of the elastomeric portion located on the first side of the longitudinal axis forming a floor of the first groove and a second portion of the peripheral surface of the elastomeric portion located on a second side of the longitudinal axis forming a floor of the second groove.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
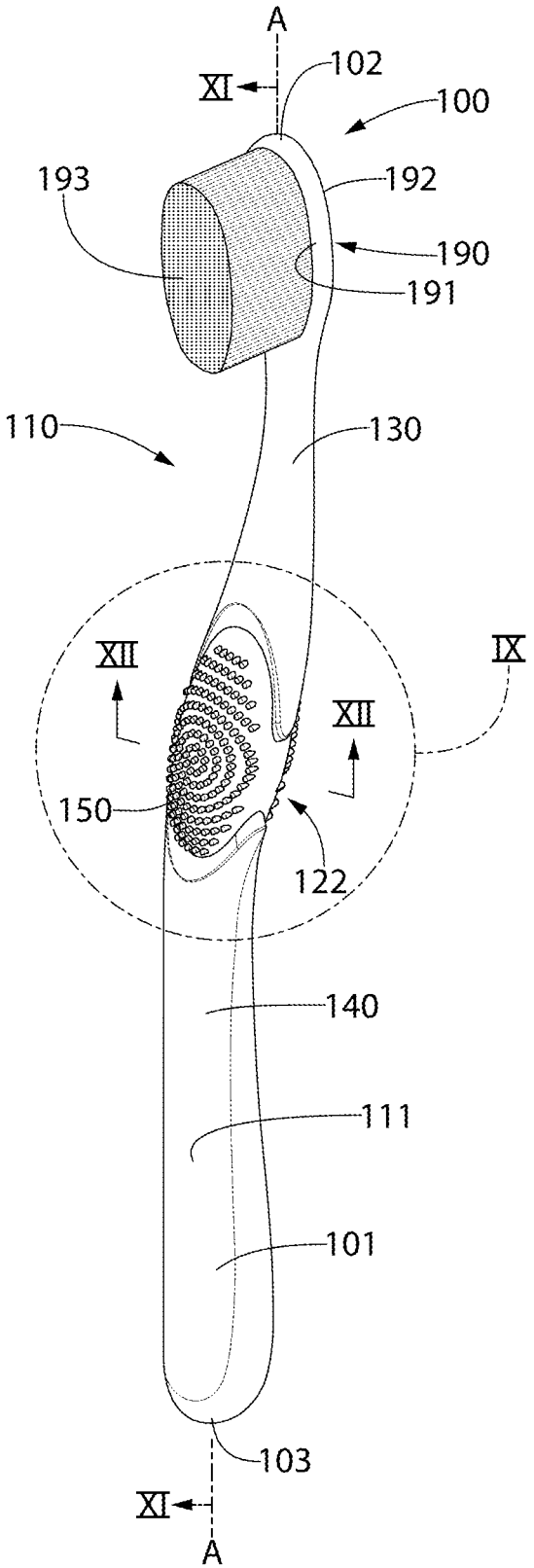
FIG. 1 is a front perspective view of a personal care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
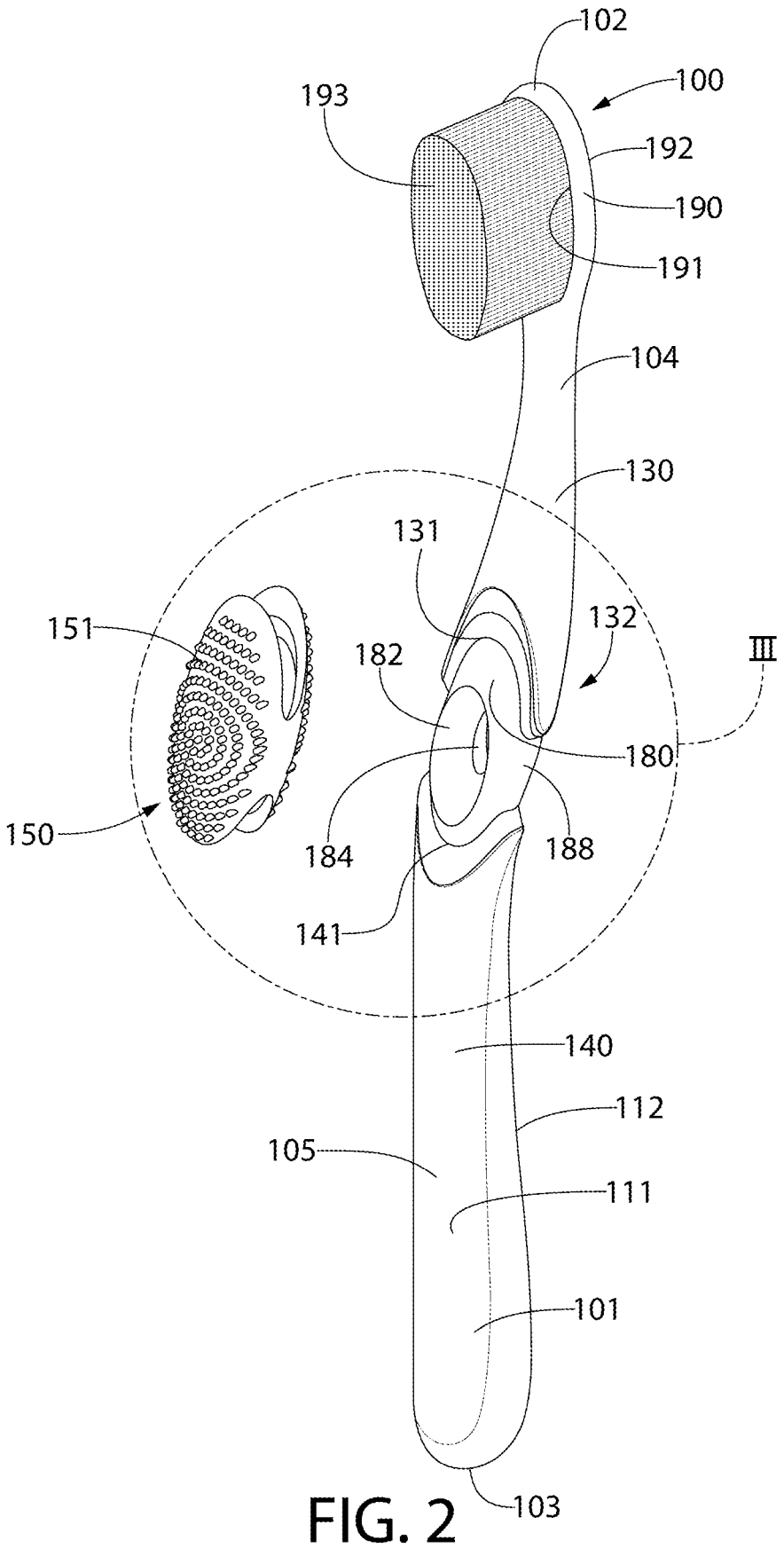
FIG. 2 is an exploded front perspective view of the personal care implement of FIG. 1.
Figure 3:
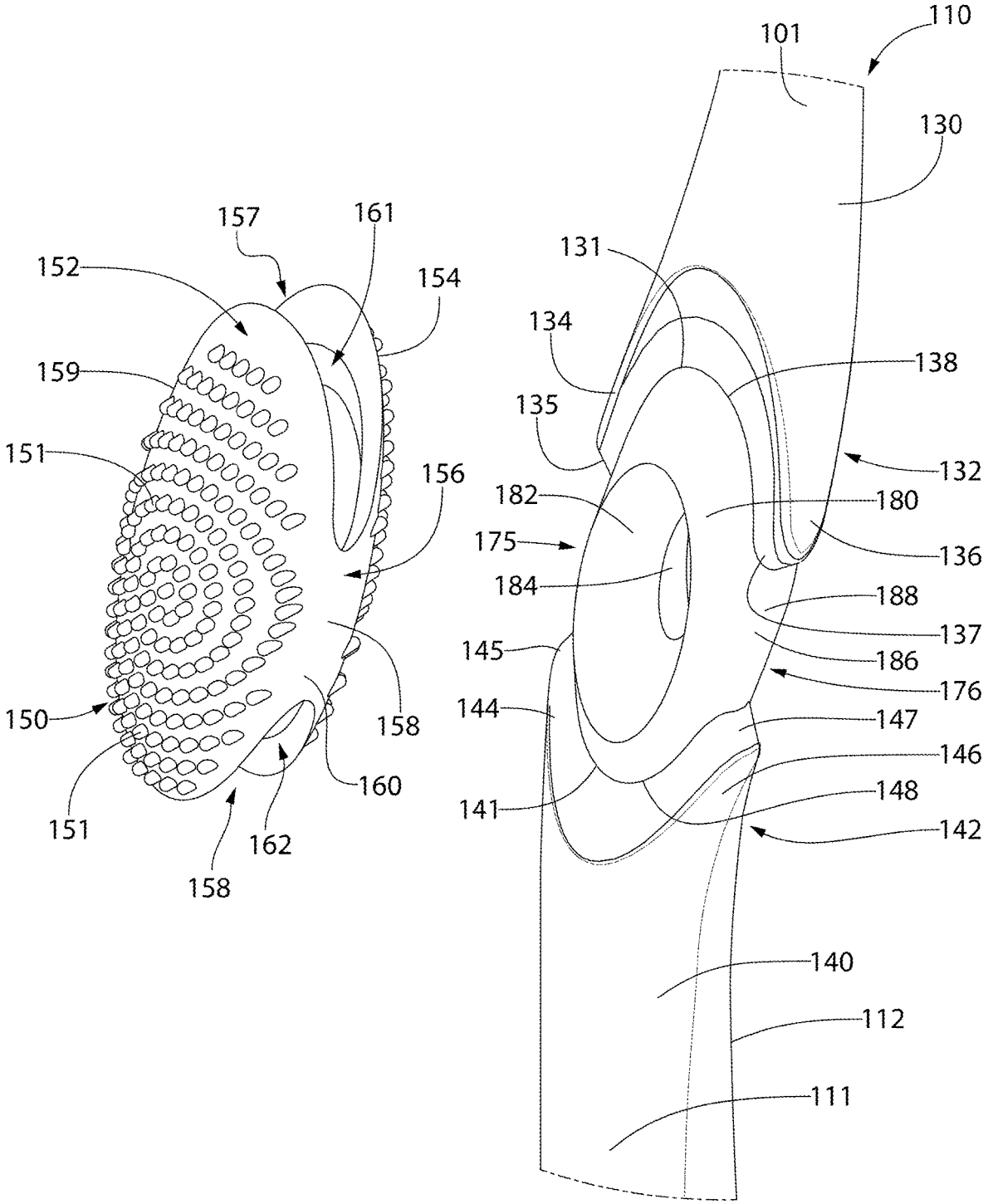
FIG. 3 is a close-up view of area III of FIG. 2.
Figure 4:
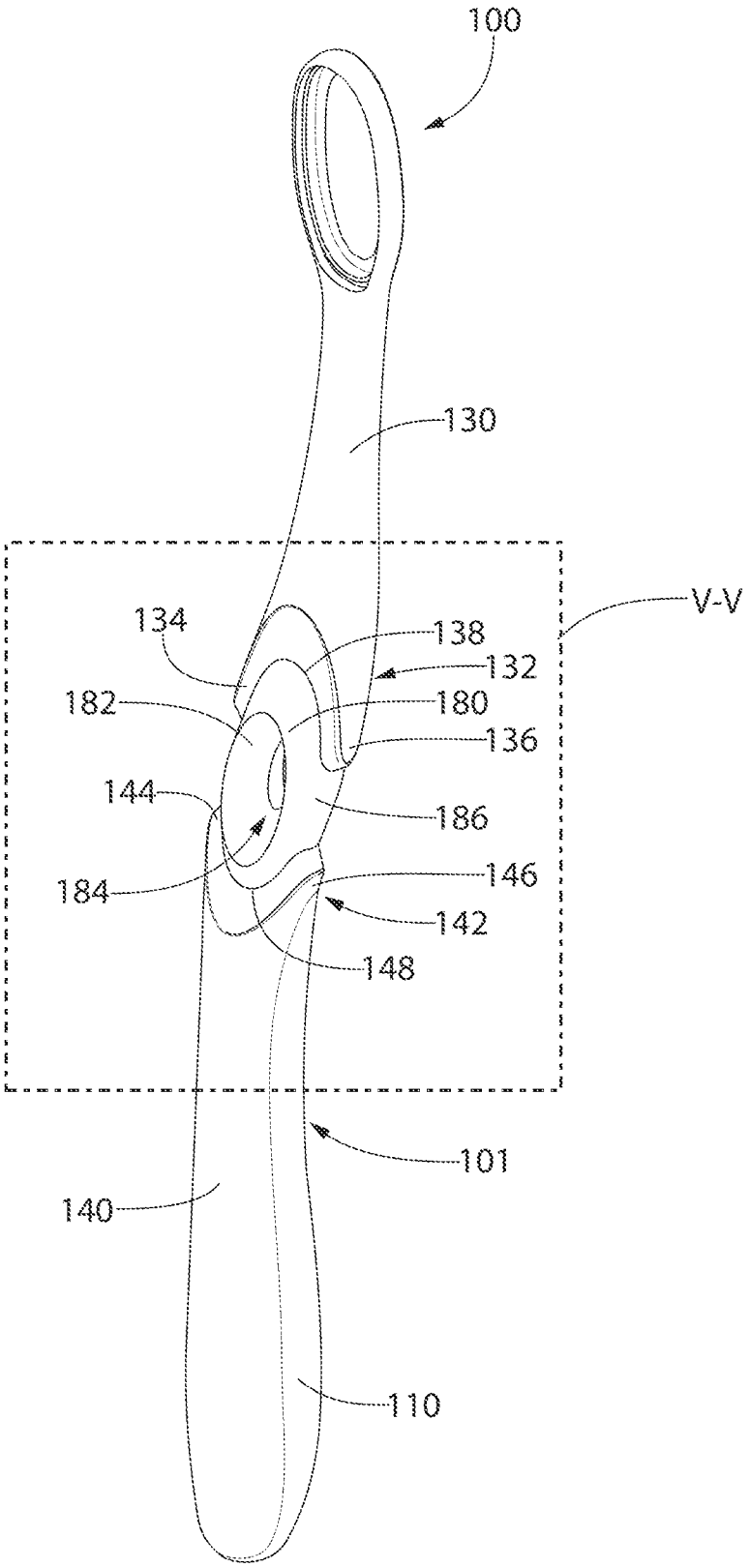
FIG. 4 is a front perspective view of a rigid body of the personal care implement of FIG. 1.
Figure 5:
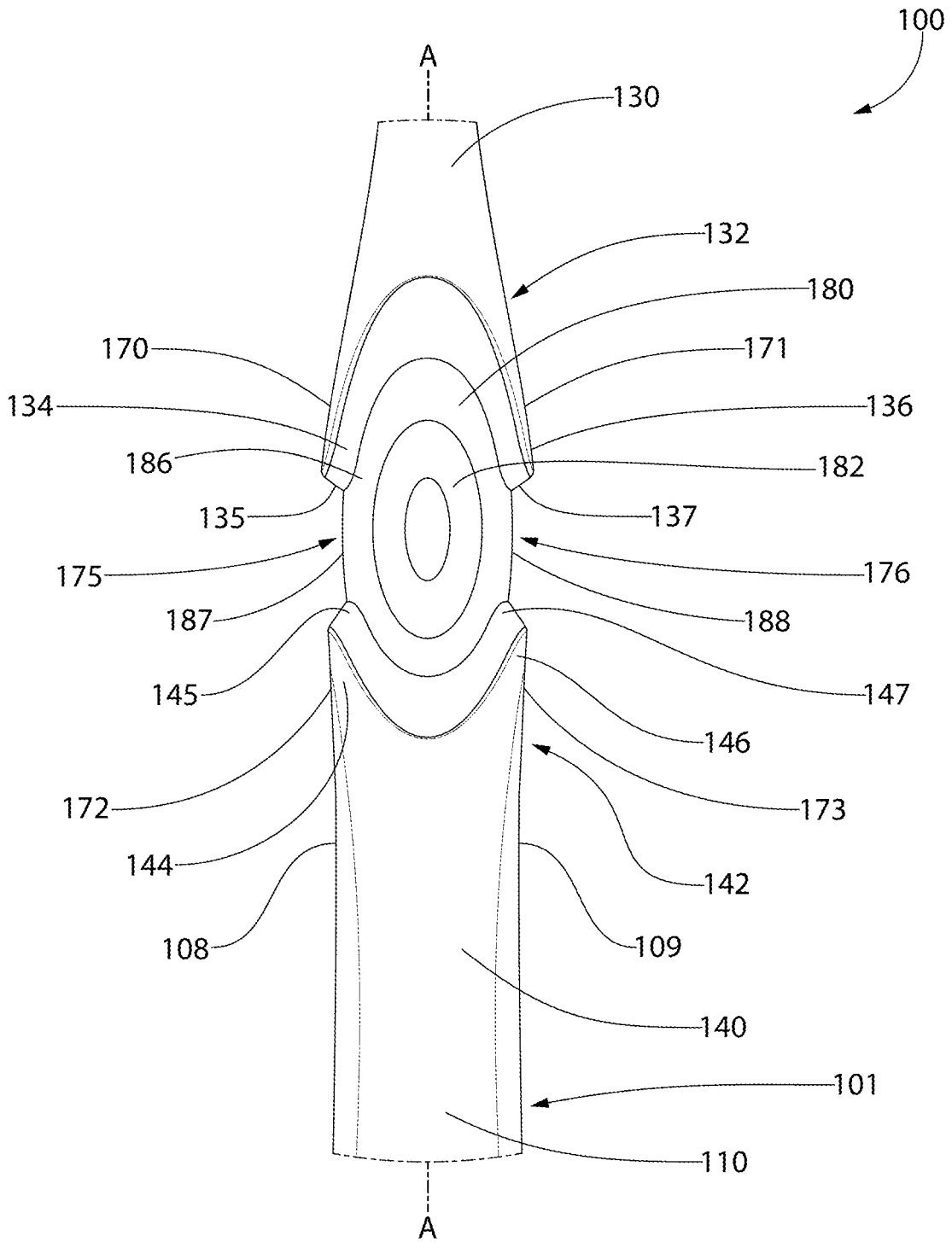
FIG. 5 is a close-up front view area V-V of FIG. 4.
Figure 6:
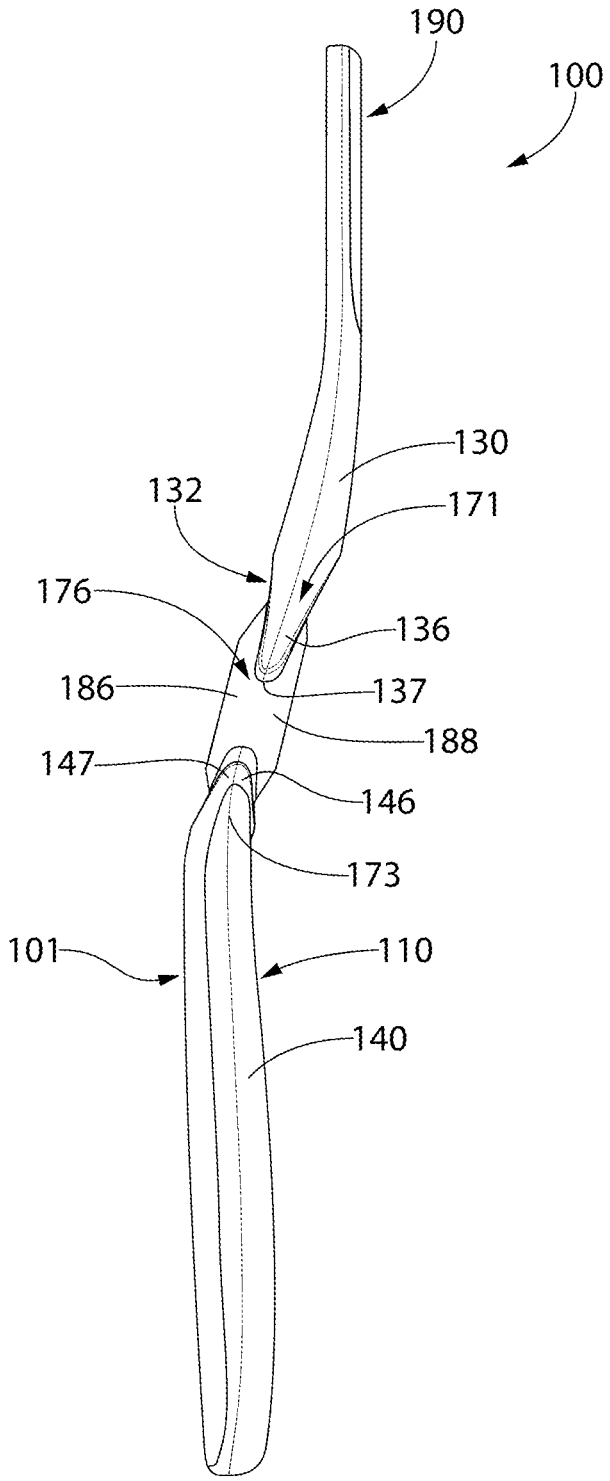
FIG. 6 is a side view of the rigid body of FIG. 4.
Figure 7:
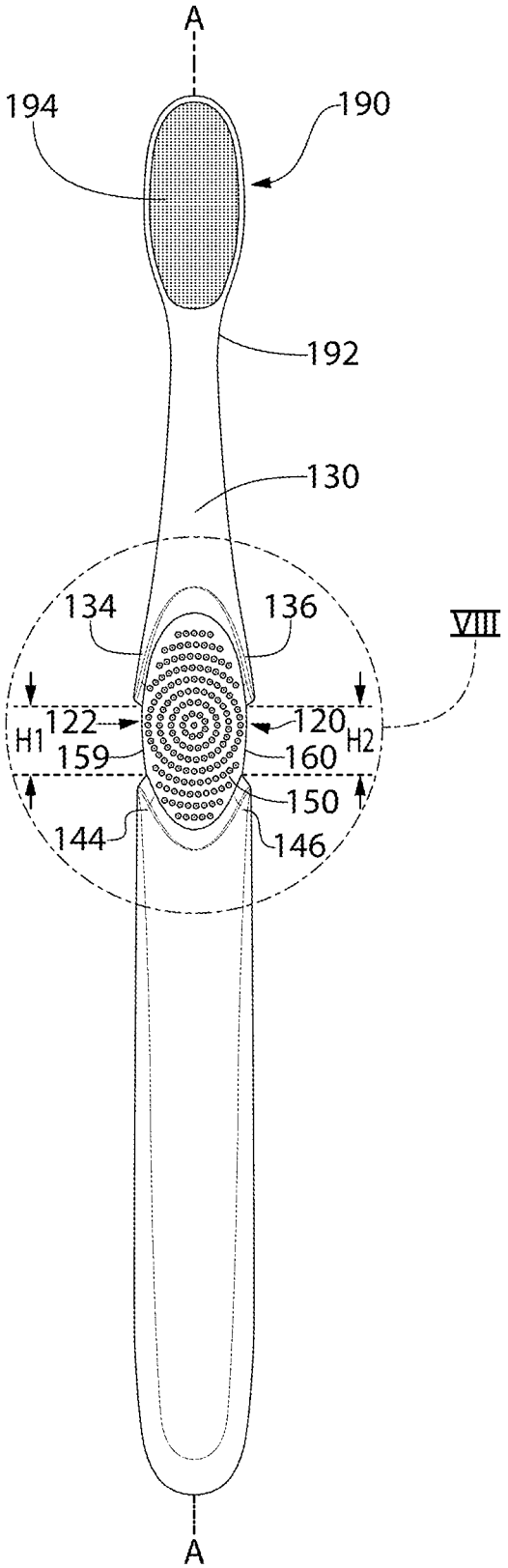
FIG. 7 is a front view of the personal care implement of FIG. 1.
Figure 8:
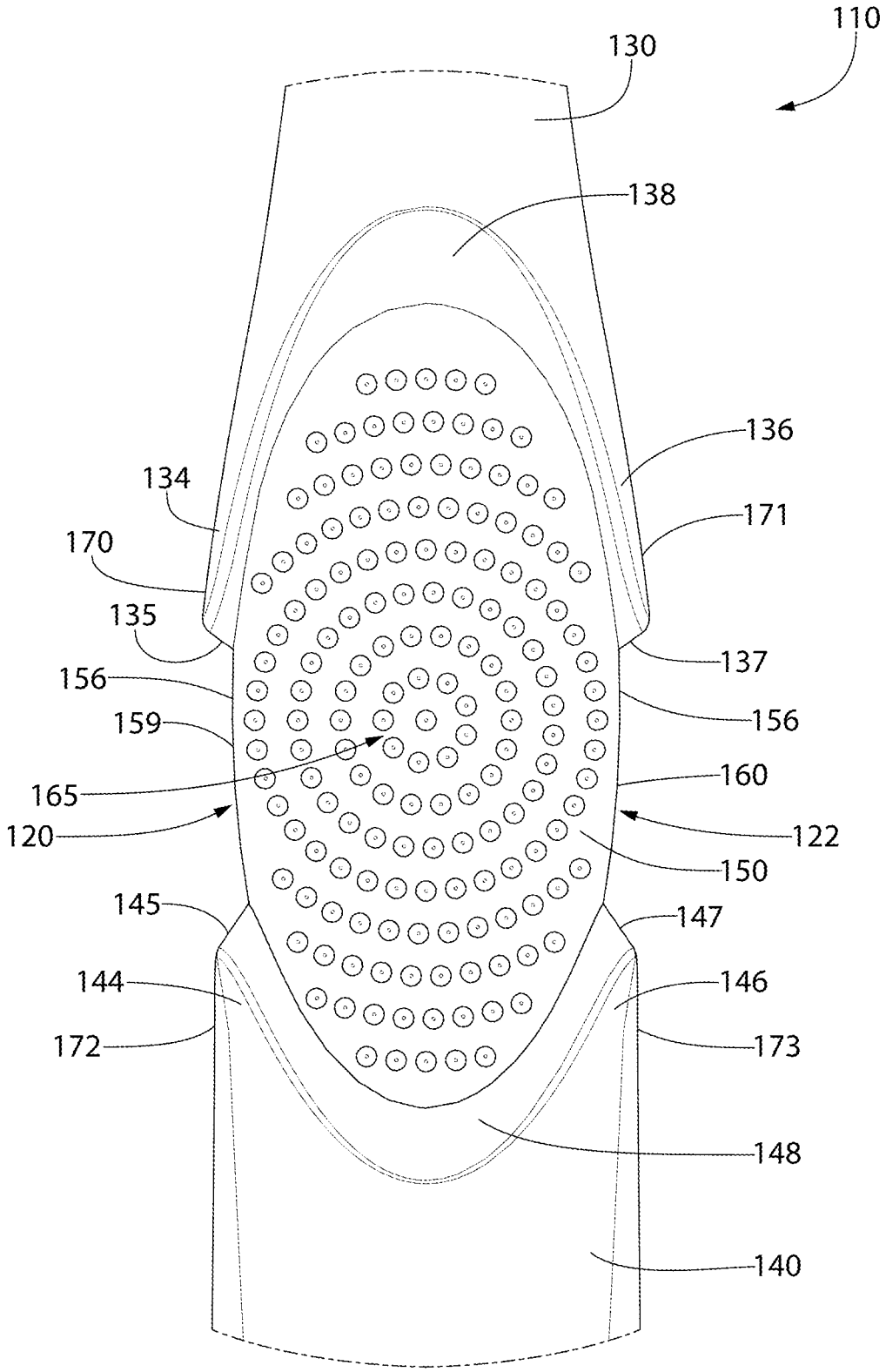
FIG. 8 is a close-up front view of area VIII of FIG. 7.
Figure 9:
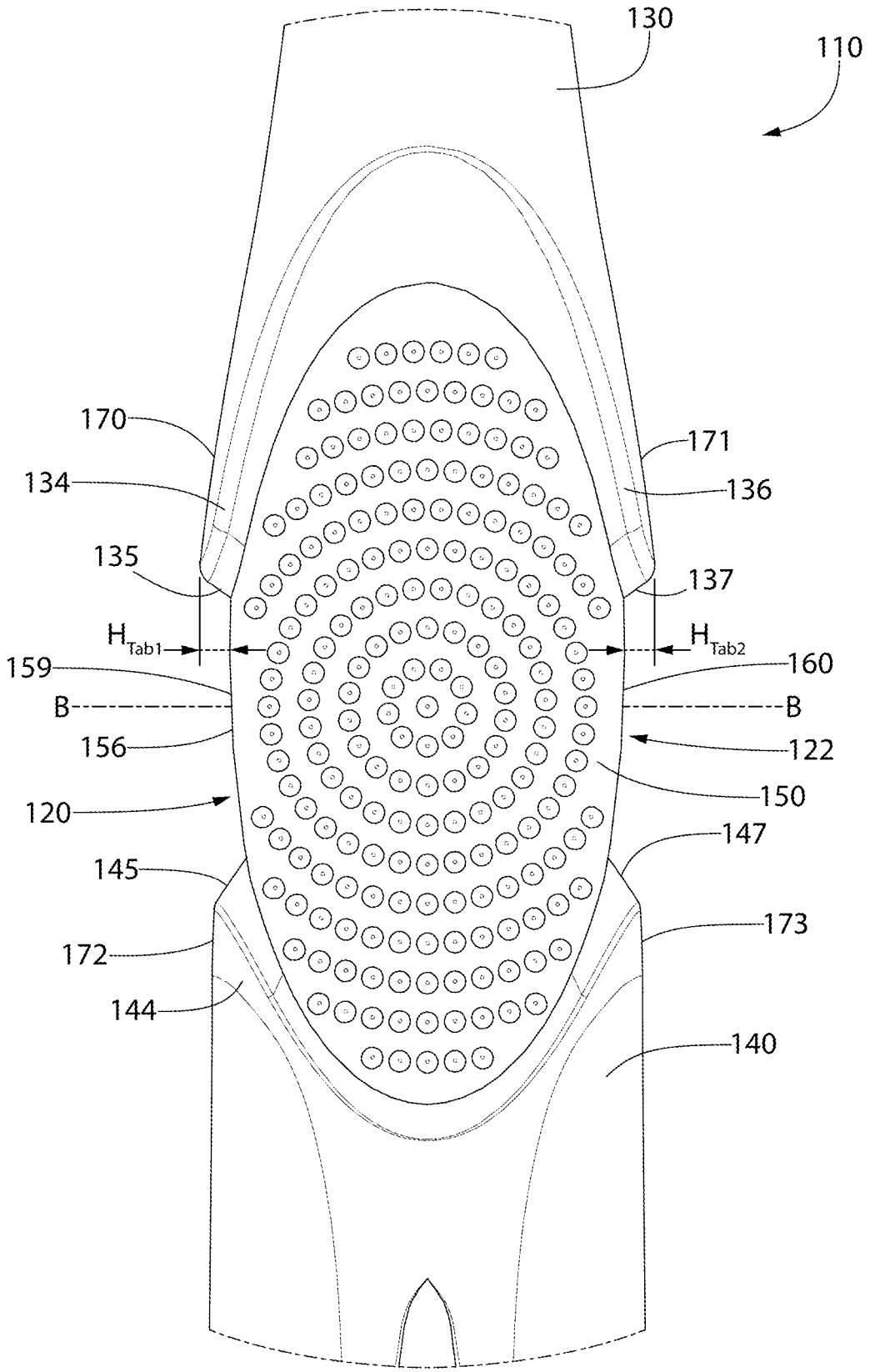
FIG. 9 is a close-up rear view of area VIII of FIG. 7.

Referring first to FIGS. 1-3, a personal care implement 100 will be described in accordance with an embodiment of the present invention. In the exemplified embodiment, the personal care implement 100 is an oral care implement such as a toothbrush, and more particularly a manual toothbrush. However, the invention is not to be so limited in all embodiments and the personal care implement 100 may take on other forms and be used for other purposes in other embodiments. For example, the personal care implement 100 may be an electric toothbrush in some alternative embodiments. In still other embodiments, the personal care implement 100 may perform other functions, such as being a flosser device, a tooth scraper, a tongue cleaner, or any of the various other tools that are commonly used for oral care. In yet other embodiments, the personal care implement 100 may be an implement used for personal care unrelated to the mouth, such as being a razor, an applicator, a hairbrush, or the like. The invention described herein relates predominately to the handle of the personal care implement 100, and thus the invention can be incorporated into implements of varying types which have handles for gripping and are used for different functions and purposes.

The personal care implement 100 generally comprises a handle 110 that extends along a longitudinal axis A-A and a head 190 that is coupled to the handle. The handle 110 is designed to minimize the amount of plastic used in the oral care implement, without sacrificing stability, durability, and functionality of the personal care implement 100. Further, the design of the handle 110 reduces the amount of plastic used in traditional personal care implements, while also providing ergonomic grooves 120 and 122 for guiding a user into a comfortable gripping position as they operate the oral care implement. The grooves 120, 122 and the manner in which they are formed will be described in greater detail below with specific reference to FIGS. 7-10.

The personal care implement 100 comprises a rigid body (also referred to herein as a rigid component or a monolithic base structure) 101 that extends from a top end 102 to a bottom end 103 along the longitudinal axis A-A and an elastomeric portion (also referred to herein as a resilient component) 150. In the exemplified embodiment, the rigid body 101 forms a portion of the handle 110 and also forms the head 190 of the personal care implement 100. The elastomeric portion 150 may form a thumb grip of the handle 110 of the personal care implement 100. Thus, the handle 110 may comprise at least a portion of the rigid body 101 in combination with the elastomeric portion 150.

The handle 110 of the personal care implement 100 is the portion that is gripped by a user during use, and the head 190 of the personal care implement is the portion that performs a particular function, such as tooth cleaning, shaving, application of a composition onto a surface, hair brushing, etc. In the exemplified embodiment, the head 190 is formed integrally with the handle 110 as a single unitary structure using a molding, milling, machining or other suitable process. However, in other embodiments the handle 110 and the head 190 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In still other embodiments, the head 190 may be detachable from the handle 110 such that replacement or refill heads may be utilized to prolong the lifespan of the handle 110 and/or enable the use of different heads with different functional components (different bristle configurations, or even different uses such as a toothbrush head and a shaver head).

The head 190 comprises a front surface 191 and a rear surface 192 opposite the front surface 191. In the exemplified embodiment, the personal care implement 100 is a toothbrush and as such the head 190 of the personal care implement 100 is provided with a generic block that illustrates tooth cleaning elements 193 extending therefrom. In particular, the tooth cleaning elements 193 are coupled to the head 190 and extend from the front surface 191 of the head 190. The exact structure, pattern, orientation and material of the tooth cleaning elements 193 is not to be limiting of the present invention in all embodiments. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 193 of the present invention can be connected to the head 190 in any manner known in the art. For example, staples/anchors, in-mold tufting (IMT), anchor free tufting (AFT), or pressure, temperature, time (PTT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. In PTT, the filaments are arranged in a tuft pattern, and then the individual filaments are melted together to form tufts that have a mushroom shaped end. The tufts are then inserted into pre-cored holes of a toothbrush head. Next, pressure and heat are applied for a particular amount of time, during which the surface of the brush head shapes itself to enclose the mushroom shaped ends of the tufts, thereby holding them firmly. Alternatively, the bristles could be mounted to tuft blocks or sections by extending through suitable openings in the tuft blocks so that the base of the bristles is mounted within or below the tuft block. Any suitable form of cleaning elements may be used in the broad practice of this invention.

In certain embodiments, the head 190 may also include a soft tissue cleaner coupled to or positioned on its rear surface 192. An example of a suitable soft tissue cleaner that may be used with the present invention and positioned on the rear surface 192 of the head 190 is disclosed in U.S. Pat. No. 7,143,462, issued Dec. 5, 2006 to the assignee of the present application, the entirety of which is hereby incorporated by reference. In certain embodiments, the soft tissue cleaner may include protuberances, which can take the form of elongated ridges, nubs, or combinations thereof. The soft tissue cleaner may also, or alternatively, comprise grooves to facilitate a tongue cleaning function.

The rigid body 101 may be formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the rigid body 101 may be formed from other materials, such as wood, metal, or the like in various other embodiments. The handle 110 may be formed with a resilient material, such as a thermoplastic elastomer, over portions of or the entirety of the rigid body 101 to enhance the gripability of the handle 110 during use. For example, portions of the rigid body 101 that are typically gripped by a user's fingers and/or palm during use may be overmolded with a thermoplastic elastomer or other resilient material to further increase comfort to a user. Certain details related to this will be described below.

As noted above, the handle 110 may comprise the rigid body 101 and the elastomeric portion 150. The rigid body 101 may comprise a front surface 111 and a rear surface 112 opposite the front surface. The rigid body 101 may comprise a first rigid portion 130 and a second rigid portion 140. Each of the first and second rigid portions 130, 140 may be formed from a hard plastic material or any of the other materials identified above. In the exemplified embodiment, the rigid body 101 also comprises a rigid core 180 that is located axially in between the first and second rigid portions 130, 140. That is, the first and second rigid portions 130, 140 may be axially spaced apart from one another by the rigid core 180. Each of the first and second rigid portions 130, 140 may be coupled to the rigid core 180 at opposite ends of the rigid core 180. In the exemplified embodiment the first and second rigid portions 130, 140 and the rigid core 180 may be integrally formed and connected as a unitary structure.

The handle 110 further comprises the elastomeric portion 150 which, in the exemplified embodiment, at least partially surrounds and covers the rigid core 180. The elastomeric portion 150 may be formed from a thermoplastic elastomer, examples of which have been provided above. The elastomeric portion 150 may be injection molded onto the rigid core 180 after the rigid body 101 has been formed. Alternatively, the elastomeric portion 150 may be formed separately from the rigid core 180 and later attached thereto using various techniques as understood by persons of ordinary skill in the art.

It should be appreciated that in alternative embodiments, the rigid core 180 may be omitted. In such embodiments, the first and second rigid portions 130, 140 of the rigid body 101 may be separate and distinct from one another rather than being formed as part of a monolithic structure, such as the rigid body 101. Furthermore, in such embodiments the first and second rigid portions 130, 140 may be coupled together by way of attachment to the elastomeric portion 150. That is, the first rigid portion 130 may be coupled to a top end of the elastomeric portion 150 and the second rigid portion 140 may be coupled to a bottom end of the elastomeric portion 150 to form the handle 110. In such an embodiment, proximal end portions of the first and second rigid portions 130, 140 may be embedded within the elastomeric portion 150 while remaining spaced apart by a central axial portion of the elastomeric portion 150. This may result in added flexibility to the handle 110 as compared to the exemplified embodiment.

The elastomeric portion 150 (shown separated from the rigid body 101 in FIGS. 2 and 3) may form a thumb grip of the handle 110 to enhance a user's grip when using the personal care implement 100. That is, the elastomeric portion 150 may be located at a position along the handle 110 which is aligned with a location where a user's thumb typically rests during use of the personal care implement 100. As noted, the elastomeric portion 150 may be injection molded onto the rigid core 180 of the rigid body 101 in a second step after the formation of the rigid body 101. Additional details regarding the relationship between the elastomeric portion 150 and the rigid body 101 will be described below with reference to FIGS. 7-12.

The elastomeric portion 150 comprises a front surface 152, a rear surface 154, and a peripheral surface 156 which is located between the front and rear surfaces 152, 154. The elastomeric portion 150 may comprise a plurality of nubs 151 protruding from at least one of the front and rear surfaces 152, 154 to increase the gripability of the elastomeric portion 150. The nubs 151 may be located on each of the front and rear surfaces 152, 154 in some embodiments (see, for example, FIG. 10). The exemplified embodiment depicts a particular arrangement of the nubs 151, but the nubs 151 may have other arrangements or patterns. Furthermore, the exact number of nubs 151 may be modified from that which is depicted in the drawings. Furthermore, in other embodiments there may be ridges, grooves, nubs, and/or combinations thereof located on the front and/or rear surfaces 152, 154 of the elastomeric portion 150 to increase comfort and gripability for a user. In other embodiments, the nubs 151 may simply be omitted. Although not illustrated in the exemplified embodiment, in some embodiments the peripheral surface 156 may also comprise a plurality of nubs.

The peripheral surface 156 of the elastomeric portion 150 comprises a top portion 157, a bottom portion 158, a first lateral side portion 159, and a second lateral side portion 160. In the exemplified embodiment, the top portion 157 of the peripheral surface 156 comprises a first notch or recess 161 and the bottom portion 158 of the peripheral surface 156 comprises a second notch or recess 162 (shown in FIG. 3). The recesses 161, 162 may be needed to accommodate the rigid body 101 as should be understood from viewing the drawings. In other embodiments, the rigid body 101 may comprise additional through-holes, such as between the top end of the rigid core 180 and the lower end of the first rigid portion 130 and between the bottom end of the rigid core 180 and the top end of the second rigid portion 140. This would allow the elastomeric portion 150 to pass through the through-holes which would result in a modification to the overall shape of the elastomeric portion 150 when exploded from the rigid body 101 as shown in FIGS. 2 and 3 (although the overall shape of the handle 110 would be maintained as shown in FIG. 1).

The elastomeric portion 150 may be a monolithic elastomeric component. Furthermore, the elastomeric portion 150 may form a bulbous body that is useful as a thumb grip. As such, the front and rear surfaces 152, 154 of the elastomeric portion 150 may be convex. However, in some embodiments, the elastomeric portion 150 may be concave or planar. As described in greater detail below, the elastomeric portion 150 may not be entirely flush with the rigid body 101 at the transition regions between the elastomeric portion 150 and the rigid body 101. This may be intentional to generate haptic regions on the personal care implement 100 to enable a user to better manipulate and control the movements of the personal care implement 100 during use. As best shown in FIG. 1, the elastomeric portion 150 may fully conceal the rigid core 180 in the assembled personal care implement 100.

Referring to FIGS. 2-6, the rigid body 101 will be further described. The first rigid portion 130 of the rigid body 101 extends from a proximal end 131 to a distal end, with the distal end of the first portion 130 of the rigid body 101 forming the top end 102 of the rigid body 101. The first rigid portion 130 comprises a neck portion 104 of the handle 110 and the head 190 (although the head 190 could be separately formed from the rigid portion 130 in other embodiments as noted above). The second rigid portion 140 of the rigid body 101 extends from a proximal end 141 to a distal end, with the distal end of the second portion 140 of the rigid body 101 forming the bottom end 103 of the rigid body 101. The second rigid portion 140 generally forms a gripping portion 105 of the handle 110 which is typically grasped by the user's fingers during use. The rigid core 180 extends between the proximal end 131 of the first rigid portion 130 and the proximal end 141 of the second rigid portion 140. The elastomeric portion 150, which conceals the rigid core 180, may also be located between the proximal end 131 of the first rigid portion 130 and the proximal end 141 of the second rigid portion 140.

In the exemplified embodiment, the rigid core 180 comprises a loop structure having an inner surface 182 that defines a through-hole 184 and an outer surface 186. The rigid core 180 may have an annular ring-like shape, such as being in the shape of a donut. The rigid core 180 has an oval shape which is elongated in a direction of the longitudinal axis A-A in the exemplified embodiment, but other shapes are possible such as circular, square, rectangular, hexagonal, octagonal, or the like.

The outer surface 186 of the rigid core 180 forms a portion of an exposed outer surface of the rigid body 101. The outer surface 186 of the rigid core 180 comprises a first side portion 187 located on a first side of the longitudinal axis A-A and a second side portion 188 located on a second side of the longitudinal axis A-A. The through-hole 184 may extend from an opening in the front surface 111 of the rigid body 101 to an opening in the rear surface 112 of the rigid body 101, with the openings being located along the rigid core 180 as shown. Thus, the through-hole 184 may extend through a full thickness of the rigid body 101 from the front surface 111 thereof to the rear surface 112 thereof. The inner surface 182 and the outer surface 186 of the rigid core 180 may be smooth to allow the elastomeric portion 150 to be easily molded through and around the rigid core 180, although the texture of those surfaces is not to be limiting of the invention in all embodiments.

While in the exemplified embodiment the rigid core 180 comprises the through-hole 184, the invention is not to be so limited in all embodiments. The rigid core 180 may be a solid structure that is free of a through-hole in some embodiments. While the through-hole 184 may be advantageous for purposes of adhering the elastomeric portion 150 to the rigid body 101, it may also be acceptable for the elastomeric portion 150 to simply surround the rigid core 180 of the rigid body 101 without also having to extend through the through-hole 184. The structural relationship between the first and second rigid portions 130, 140 of the rigid body 101 relative to the rigid core 180 of the rigid body 101 described below may be maintained even while modifications are made to the shape and structure (e.g., whether it contains the through-hole 184 or not) of the rigid core 180. The rigid core 180 may connect the first rigid portion 130 to the second rigid portion 140, so that the rigid body 101 is formed as an integral monolithic structure.

The first rigid portion 130 includes a first end portion 132 located adjacent to a top end of the rigid core 180. The first end portion 132 of the first rigid portion 130 comprises the proximal end 131 of the first rigid portion 130. The first end portion 132 of the first rigid portion 130 may comprise a first tab 134 that terminates at a first distal end 135, a second tab 136 that terminates at a second distal end 137, and an end surface 138 that extends between the first and second tabs 134, 136. The first tab 134 comprises an outer surface 170 and the second tab 136 comprises an outer surface 171. The outer surfaces 170, 171 form a portion of an exposed outer surface of the first rigid portion 130 of the rigid body 101 of the handle 110. More specifically, the rigid body 101 may comprise a first lateral side 108 located on a first side of the longitudinal axis A-A and a second lateral side 109 located on a second side of the longitudinal axis A-A, with the first and second lateral sides 108, 109 forming a portion of the exposed outer surface of the rigid body 101 which is located between the front and rear surfaces 111, 112. The outer surface 170 of the first tab 134 may form a portion of the first lateral side 108 of the first rigid portion 130 of the rigid body 101 and the outer surface 171 of the second tab 136 may form a portion of the second lateral side 109 of the first rigid portion 130 of the rigid body 101.

The first tab 134 may be located on a first side of the longitudinal axis A-A and the second tab 136 may be located on a second side of the longitudinal axis A-A. The distal end 135 of the first tab 134 projects outwardly from the first side portion 187 of the outer surface 186 of the rigid core 180. As such, the first side portion 187 of the outer surface 186 of the rigid core 180 is recessed relative to the outer surface 170 of the first tab 134. Furthermore, the distal end 137 of the second tab 136 projects outwardly from the second side portion 188 of the outer surface 186 of the rigid core 180. As such, the second side portion 188 of the outer surface 186 of the rigid core 180 is recessed relative to the outer surface 171 of the second tab 136.

While the invention is shown and described with the tabs 134, 135, 144, 145, in some embodiments the tabs may be omitted and the end surfaces of the first and second rigid portions 130, 140 may be horizontal rather than arcuate, or have other shapes (wavy, linear but angled relative to the longitudinal axis, etc.). In such embodiments the end surfaces of the first and second rigid portions 130, 140 may still be axially spaced apart to form the grooves 121, 122 as described herein by having the first and second rigid portions 130, 140 protrude from or relative to the elastomeric portion 150 while being spaced apart to create a groove or recessed region as shown. For example, rather than having the arcuate shape, the end of the first and second rigid portions 130, 140 could be aligned with the distal ends of the tabs 134, 135, 144, 145 while maintaining the space between the first and second rigid portions 130, 140 and also maintaining the grooves/recesses on the opposing lateral sides of the handle 110.

In the exemplified embodiment, the end surface 138 of the first end portion 132 of the first rigid portion 130 is arcuate. More specifically, in the exemplified embodiment the end surface 138 is concave. However, the invention is not to be so limited in all embodiments and the end surface 138 could be planar, V-shaped, square/rectangular shaped (including 3 sides of a square/rectangular shape), or any other shape.

The second rigid portion 140 includes a second end portion 142 located adjacent to a bottom end of the rigid core 180. The second end portion 142 of the second rigid portion 140 comprises the proximal end 141 of the second rigid portion 140. The second end portion 142 of the second rigid portion 140 may comprise a first tab 144 that terminates at a first distal end 145, a second tab 146 that terminates at a second distal end 147, and an end surface 148 that extends between the first and second tabs 144, 146. The first tab 144 comprises an outer surface 172 and the second tab 146 comprises an outer surface 173. The outer surfaces 172, 173 form a portion of an exposed outer surface of the second rigid portion 140 of the rigid body 101 of the handle 110. More specifically, the outer surface 172 of the first tab 144 may form a portion of the first lateral side 108 of the second rigid portion 140 of the rigid body 101 and the outer surface 173 of the second tab 146 may form a portion of the second lateral side 109 of the second rigid portion 140 of the rigid body 101.

The first tab 144 of the second rigid portion 140 may be located on the first side of the longitudinal axis A-A (i.e., the same side as the first tab 134 of the first rigid portion 130). The second tab 146 of the second rigid portion 140 may be located on the second side of the longitudinal axis A-A (i.e., the same side as the second tab 136 of the first rigid portion 130). The distal end 145 of the first tab 144 projects outwardly from the first side portion 187 of the outer surface 186 of the rigid core 180. As such, the first side portion 187 of the outer surface 186 of the rigid core 180 is recessed relative to the outer surface 172 of the first tab 144. Furthermore, the distal end 147 of the second tab 146 projects outwardly from the second side portion 188 of the outer surface 186 of the rigid core 180. As such, the second side portion 188 of the outer surface 186 of the rigid core 180 is recessed relative to the outer surface 173 of the second tab 146.

In the exemplified embodiment, the end surface 148 of the second end portion 142 of the second rigid portion 140 is arcuate. More specifically, in the exemplified embodiment the end surface 148 is concave. However, the invention is not to be so limited in all embodiments and the end surface 148 could be planar, V-shaped, square/rectangular shaped (including 3 sides of a square/rectangular shape), or any other shape.

As noted above, the first tabs 134, 144 of the first and second rigid portions 130, 140 of the rigid body 101 are located on the first side of the longitudinal axis A-A. Furthermore, the distal ends 135, 145 of the first tabs 134, 144 are axially spaced apart from one another. Moreover, because the distal ends 135, 145 of the first tabs 134, 144 project or protrude outwardly from the first side portion 187 of the outer surface 186 of the rigid core 180, a first channel 175 is formed between the distal ends 135, 145 of the first tabs 134, 144. The first side portion 187 of the outer surface 186 of the rigid core 180 forms a floor of the first channel 175.

As noted above, the second tabs 136, 146 of the first and second rigid portions 130, 140 of the rigid body 101 are located on the second side of the longitudinal axis A-A. Furthermore, the distal ends 137, 147 of the second tabs 136, 146 are axially spaced apart from one another. Moreover, because the distal ends 137, 147 of the second tabs 136, 146 project or protrude outwardly from the second side portion 188 of the outer surface 186 of the rigid core 180, a second channel 176 is formed between the distal ends 137, 147 of the second tabs 136, 146. The second side portion 188 of the outer surface 186 of the rigid core 180 forms a floor of the second channel 176.

Figure 10:
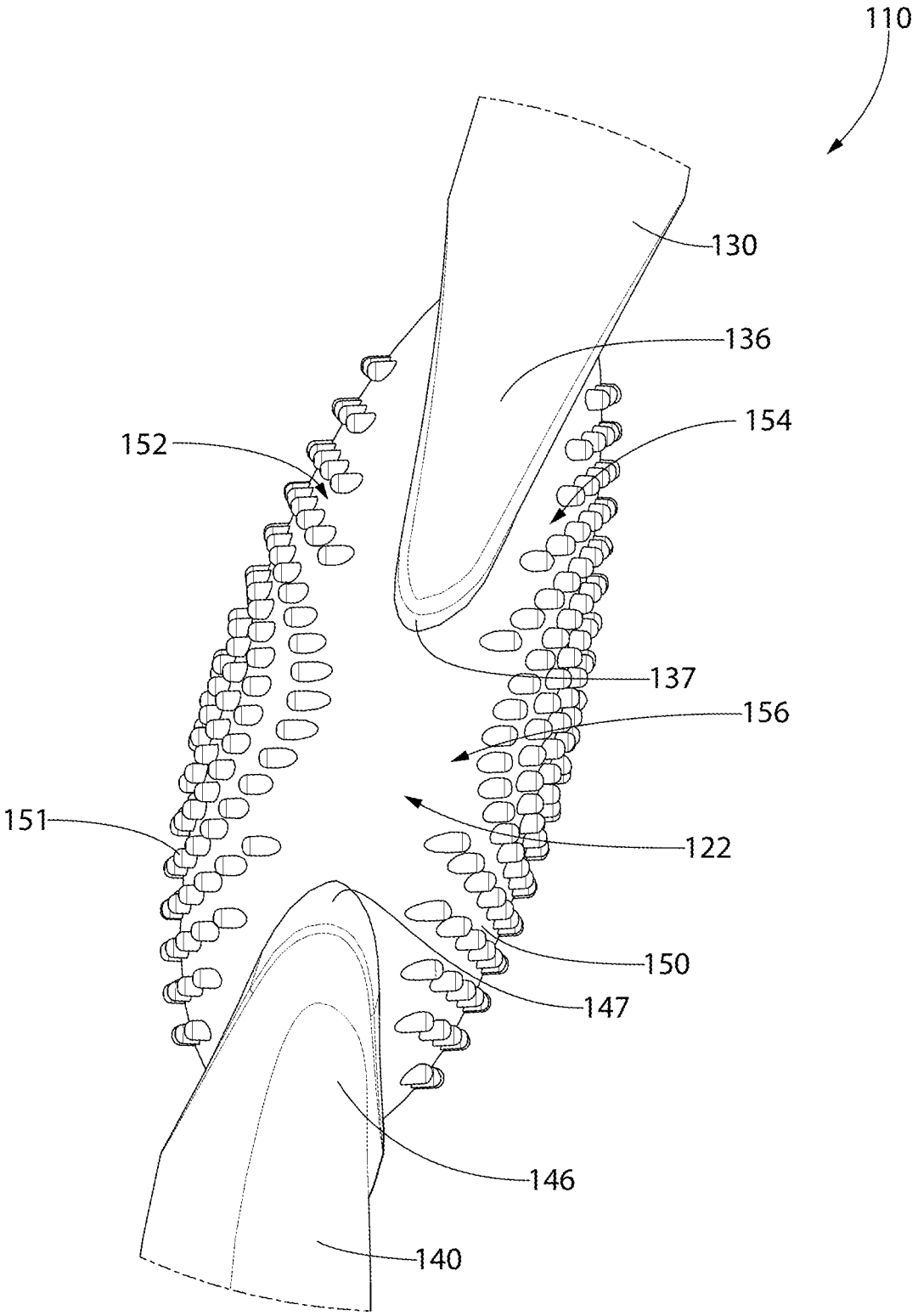
FIG. 10 is a close-up side view of area VIII of FIG. 7.
Figure 11:
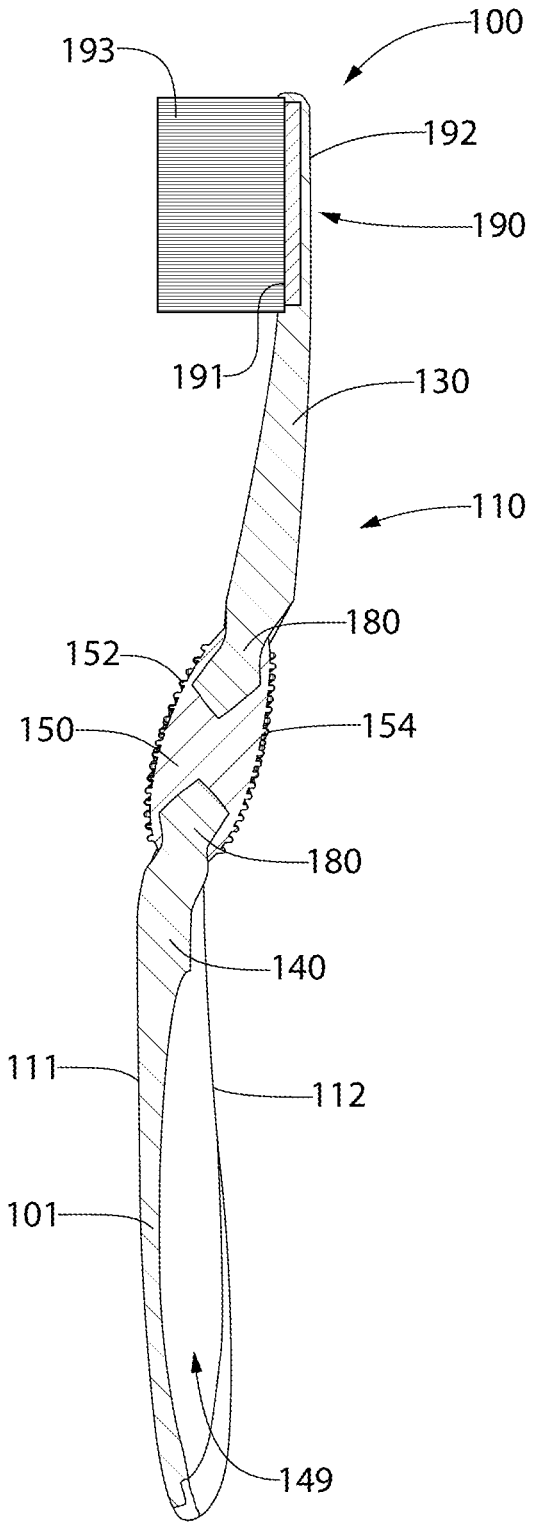
FIG. 11 is a cross-sectional view taken along line XI of FIG. 1.
Figure 12:
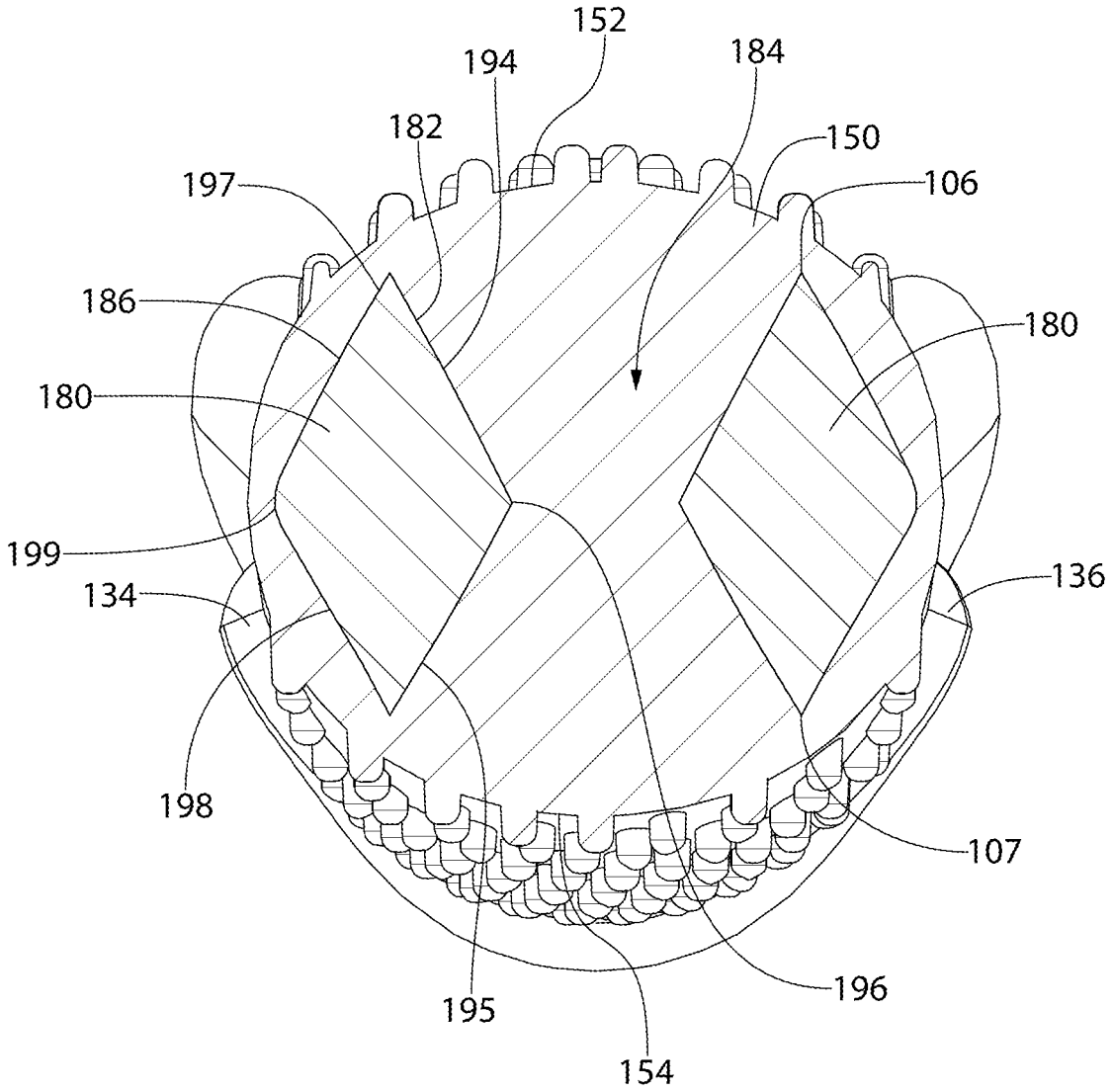
FIG. 12 is a cross-sectional view taken along line XII of FIG. 1.

Referring to FIGS. 7-12, various views of the assembled personal care implement 100 are provided which includes the elastomeric portion 150 coupled to the rigid core 180 of the rigid body 101. As discussed above, the elastomeric portion 150 may be injection molded onto the rigid body 101 so as to cover/conceal the rigid core 180. As best seen in FIGS. 11 and 12, the elastomeric portion 150 extends into and through the through-hole 184 of the rigid core 180 and also covers an entirety of the outer surface 186 of the rigid core 180. As described herein, the elastomeric portion 150 is a monolithic body, and as such it fills the through-hole 184 of the rigid core 180 while covering the entirety of the rigid core 180.

In the exemplified embodiment, the elastomeric portion 150 is not flush with the outer surfaces of the first and second rigid portions 130, 140. More specifically, the elastomeric portion 150 is not flush with the outer surfaces 170, 171, 172, 173 of the first and second tabs 134, 136, 144, 146 of the first and second rigid portions 130, 140. Rather, the first lateral side portion 159 of the elastomeric portion 150 is recessed relative to the outer surfaces 170, 172 of the first tabs 134, 144 of the first and second rigid portions 130, 140. Thus, the distal ends 135, 145 of the first tabs 134, 144 of the first and second rigid portions 130, 140 protrude relative to the first lateral side portion 159 of the peripheral surface 156 of the elastomeric portion 150. A height $H_{tab1}$ of the first tabs 134, 144 at the distal ends 135, 145 as measured from the first lateral side portion 159 to the outer surface 170, 172 may be between 0.5 mm and 3 mm, and more specifically between 2 mm and 3 mm. As a result, the first groove 120 (mentioned briefly above) is formed between the distal ends 135, 145 of the first tabs 134, 144 of the first and second rigid portions 130, 140, with the first lateral side portion 159 of the peripheral surface 156 of the elastomeric portion (or elastomeric body) 150 forming a floor of the first groove 120. The first groove 120 may be located on the first side of the longitudinal axis.

Similarly, the second lateral side portion 160 of the elastomeric portion 150 is recessed relative to the outer surfaces 171, 173 of the second tabs 136, 146 of the first and second rigid portions 130, 140. Thus, the distal ends 137, 147 of the second tabs 136, 146 of the first and second rigid portions 130, 140 protrude relative to the second lateral side portion 160 of the peripheral surface 156 of the elastomeric portion 150. A height $H_{tab2}$ of the second tabs 136, 146 at the distal ends 137, 147 as measured from the second lateral side portion 160 to the outer surface 171, 173 may be between 0.5 mm and 3 mm, and more specifically between 2 mm and 3 mm. As a result, the second groove 122 (mentioned briefly above) is formed between the distal ends 137, 147 of the second tabs 136, 146 of the first and second rigid portions 130, 140, with the second lateral side portion 160 of the peripheral surface 156 of the elastomeric portion (or elastomeric body) 150 forming a floor of the second groove 122. The second groove 122 may be located on the second side of the longitudinal axis A-A.

The elastomeric portion 150 comprises an exposed annular portion 165 that surrounds the longitudinal axis A-A. The exposed annular portion 165 comprises a portion of the front surface 152, the portion of the first lateral side 159 that is located between the first tabs 134, 144, a portion of the rear surface 154, and the portion of the second lateral side 160 that is located between the second tabs 136, 146. The exposed annular portion 165 may be oriented perpendicular relative to the longitudinal axis A-A.

The first groove 120 may have a first height H1 measured between the distal ends 135, 145 of the first tabs 134, 144 of the first and second rigid portions 130, 140. The second groove 122 may have a second height H2 measured between the distal ends 137, 147 of the second tabs 136, 146 of the first and second rigid portions 130, 140. The first and second heights H1, H2 may be the same, although this is not required in all embodiments. The first and second heights H1, H2, may be size and configured so that a tip of a user's pointer finger fits within the first and second grooves 120, 122. The first and second heights H1, H2 may be between 1 mm and 10 mm, and more specifically between 2 mm and 8 mm in some embodiments. The grooves 120, 122 provide a nesting location for the tip of the user's pointer finger (or a portion thereof) while the user's thumb rests on the front surface 152 of the elastomeric portion (i.e., thumb grip), which may increase the user's ability to grip and control the personal care implement 100 during use. Thus, the first and second grooves 120, 122 may help to promote ergonomic gripping by guiding a user into a comfortable gripping position as they operate the personal care implement 100.

The first and second lateral sides 159, 160 of the peripheral surface 156 of the elastomeric portion (or thumb grip) 150 are recessed relative to the exposed outer surfaces 170, 171, 172, 173 of the first and second tabs 134, 144, 136, 146. The greater the height of the recess between the thumb grip 150 and the first and second tabs 134, 144, 136, 146, the deeper the grooves 120, 122 that are formed. In some embodiments, the distal ends 135, 145, 137, 147 of the first and second tabs 134, 144, 136, 146 may be rounded or tapered (as best shown in FIG. 10). This tapering of the distal ends 134, 144, 136, 146 may allow for a more comfortable grip for the user. The configuration and structure described herein allows for the ability to grasp using a precision grip which may provide the user with better control and movement of the personal care implement 100 during use.

Turning to FIGS. 11 and 12, in the exemplified embodiment the inner and outer surfaces 182, 186 of the rigid core 180 may be V-shaped. The rigid core 180 comprises a front surface 106 and a rear surface 107 opposite the front surface. The inner surface 182 of the rigid core 180 comprises a first linear portion 194 that extends from the front surface 106 inwardly into the through-hole 184 and a second linear portion 195 that extends from the rear surface 107 inwardly into the through-hole 184. The first and second linear portions 194, 195 intersect at an apex 196. The apex 196 is pointed in the exemplified embodiment, although it could be rounded in other embodiments. The outer surface 186 of the rigid core 180 comprises a first linear portion 197 that extends from the front surface 106 and a second linear portion 198 that extends from the rear surface 107, with the first and second linear portions 197, 198 intersecting at an apex 199. The apex 199 is pointed in the exemplified embodiment, but could be rounded in other embodiments.

The first linear portion 194 of the inner surface 182 may intersect the first linear portion 197 of the outer surface 186 at a point along the front surface 106. The first linear portions 194, 197 may be oriented so as to converge as they move towards the front surface 106 at an acute angle. The second linear portion 195 of the inner surface 182 may intersect the second linear portion 198 of the outer surface 186 at a point along the rear surface 107. The second linear portions 195, 198 may be oriented so as to converge as they move towards the rear surface 107 at an acute angle.

The cross-sectional area of the through-hole 184 may decrease moving from the front opening of the through-hole 184 to a central point of the through-hole 184, and may similarly decrease moving from the rear opening of the through-hole 184 to the central point. This may further assist in maintaining the elastomeric portion 150 coupled to the rigid body 101 once injection molded thereon. In other embodiments, the cross-sectional area of the through-hole 184 may be constant.

As mentioned before, the personal care implement 100 reduces the overall plastic being used by designing the first tabs 134, 144 and the second tabs 136, 146 to be spaced apart from one another by at least portions of the first and second lateral sides 159, 160 of the peripheral surface 156 of the elastomeric portion 150, as opposed to being fully connected. Not only does this spaced distance reduce the overall amount of plastic, but it forms the first and second grooves 120, 122. The first and second grooves 120, 122 have the first and second heights H1, H2 measured in the direction of the longitudinal axis A-A between the first tabs 134, 144 and the second tabs 136, 146. The first and second heights H1, H2 of the grooves 120, 122 may be designed to accommodate a user's finger. The first and second grooves 120, 122 may also have a height Htab1, Htab2 measured in a direction of a transverse axis B-B from the first and second lateral sides 159, 160 of the elastomeric portion 150 to the outer surface of the first and second tabs 134, 144, 136, 146. The height may be designed to accommodate a user's finger during operation of the personal care implement 100. The transverse axis, B-B, which is perpendicular to longitudinal axis A-A, may intersect the elastomeric portion 150 without intersecting the first and second rigid portions 130, 140 of the rigid body 101. The transverse axis B-B may of course intersect the rigid core 180 of the rigid body 101.

In some embodiments, the handle 110 may have a cavity 149 in the rear surface of the second rigid portion 140. The cavity 149, best shown in FIG. 12, may further reduce the amount of plastic used in the formation of the handle 110. In some embodiments, the cavity 149 may be partially or completely filled with elastomeric material, similar to the process used for filling the rigid core 180. The elastomeric material in the cavity 149 may have a smooth surface texture, or may include ridges or nubs, and/or may include a texture to enhance the gripability.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A personal care implement comprising:

a handle comprising a first rigid portion having a first end portion, a second rigid portion having a second end portion, and an elastomeric portion located at least partially between the first end portion of the first rigid portion and the second end portion of the second rigid portion, the handle extending along a longitudinal axis;

the elastomeric portion comprising a front surface, a rear surface, and a peripheral surface that extends between the front and rear surfaces;

wherein a first groove is formed between the first end portion of the first rigid portion and the second end portion of the second rigid portion on a first side of the longitudinal axis and a second groove is formed between the first end portion of the first rigid portion and the second end portion of the second rigid portion on a second side of the longitudinal axis, a first portion of the peripheral surface of the elastomeric portion located on the first side of the longitudinal axis forming a floor of the first groove and a second portion of the peripheral surface of the elastomeric portion located on a second side of the longitudinal axis forming a floor of the second groove;

wherein the first end portion of the first rigid portion comprises a first tab located on the first side of the longitudinal axis and a second tab located on the second side of the longitudinal axis, wherein the second end portion of the second rigid portion comprises a first tab located on the first side of the longitudinal axis and a second tab located on the second side of the longitudinal axis, and wherein each of the first and second tabs of each of the first and second rigid portions terminates in a distal end that protrudes from the peripheral surface of the elastomeric portion.

2. The personal care implement according to claim 1 wherein the peripheral surface of the elastomeric portion comprises a first lateral side located on the first side of the longitudinal axis and a second lateral side located on the second side of the longitudinal axis, the first lateral side comprising the first portion of the peripheral surface and the second lateral side comprising the second portion of the peripheral surface, the first tabs of the first and second rigid portions being located on the first side of the longitudinal axis and being axially spaced apart by the first portion of the peripheral surface of the elastomeric portion, and the second tabs of the first and second rigid portions being located on the second side of the longitudinal axis and being axially spaced apart by the second portion of the peripheral surface of the elastomeric portion.

3. The personal care implement according to claim 1 wherein the first end portion of the first rigid portion comprises a first arcuate end surface extending between the first and second tabs of the first rigid portion, and wherein the second end portion of the second rigid portion comprises a second arcuate end surface extending between the first and second tabs of the second rigid portion, the first arcuate end surface adjacent to a top end of the elastomeric portion and the second arcuate end surface adjacent to a bottom end of the elastomeric portion.

4. The personal care implement according to claim 1 wherein the first and second portions of the peripheral surface of the elastomeric portion are recessed relative to an outer surface of the first and second rigid portions located at a distal end of the first end portion of the first rigid portion and a distal end of the second end portion of the second rigid portion.

5. The personal care implement according to claim 1 wherein the elastomeric portion is a bulbous body such that the front and rear surfaces of the elastomeric portion are convex, and further comprising a plurality of nubs extending from each of the front and rear surfaces of the elastomeric portion.

6. The personal care implement according to claim 1 wherein the handle further comprises a rigid core comprising an inner surface that defines a through hole and an outer surface, and wherein the elastomeric portion is a monolithic body that fills the through hole and covers an entirety of the outer surface of the rigid core.

7. The personal care implement according to claim 6 wherein the first end portion of the first rigid portion comprises a first tab and a second tab and wherein the second end portion of the second rigid portion comprises a first tab and a second tab, wherein the first and second tabs of each of the first and second rigid portions terminates in a distal end that protrudes from the outer surface of the rigid core, and wherein the first rigid portion, the second rigid portion, and the rigid core are integrally connected to form a monolithic base structure of the personal care implement.

8. The personal care implement according to claim 1 wherein a transverse axis that is perpendicular to the longitudinal axis intersects the elastomeric portion of the handle without intersecting the first and second rigid portions of the handle.

9. The personal care implement according to claim 1 wherein the elastomeric portion of the handle has an oval shape that is elongated in a direction of the longitudinal axis.

10. The personal care implement according to claim 1 wherein the first rigid portion forms a head of the personal care implement, and further comprising a plurality of tooth cleaning elements extending from the head.

11. The personal care implement according to claim 1 wherein the elastomeric portion comprises an outer surface having an exposed annular portion that surrounds the longitudinal axis.

12. A personal care implement comprising:

a handle comprising a first rigid portion, a second rigid portion, and an elastomeric portion located between the first and second rigid portions, the elastomeric portion forming a thumb grip comprising a front surface, a rear surface, and a peripheral surface that extends between the front and rear surfaces;

the first rigid portion comprising a first end portion that is adjacent to a top portion of the thumb grip, the first end portion comprising a first tab and a second tab;

the second rigid portion comprising a second end portion that is adjacent to a bottom portion of the thumb grip, the second end portion comprising a first tab and a second tab;

wherein the first and second tabs of each of the first and second rigid portions comprises an exposed outer surface; and wherein a portion of the peripheral surface of the thumb grip is recessed relative to the exposed outer surface of the first and second tabs of each of the first and second rigid portions such that each of the first and second tabs of each of the first and second rigid portions terminates in a distal end that protrudes from the peripheral surface of the thumb grip.

13. The personal care implement according to claim 12 wherein the handle comprises a longitudinal axis and the peripheral surface of the thumb grip comprises a first lateral side located on a first side of the longitudinal axis and a second lateral side located on a second side of the longitudinal axis, the first tabs of the first and second rigid portions being located on the first side of the longitudinal axis and being axially spaced apart by at least a portion of the first lateral side of the peripheral surface of the thumb grip, and the second tabs of the first and second rigid portions being located on the second side of the longitudinal axis and being axially spaced apart by at least a portion of the second lateral side of the peripheral surface of the thumb grip.

14. The personal care implement of claim 13 wherein a first groove is formed between the first tab of the first rigid portion and the first tab of the second rigid portion, the portion of the first lateral side of the peripheral surface of the thumb grip forming a floor of the first groove, and wherein a second groove is formed between the second tab of the first rigid portion and the second tab of the second rigid portion, the portion of the second lateral side of the peripheral surface of the thumb grip forming a floor of the second groove.

15. The personal care implement according to claim 12 wherein each of the first and second tabs of each of the first and second rigid portions terminates in a distal end that is located along the peripheral surface of the thumb grip.

16. The personal care implement according to claim 12 wherein the handle further comprises a rigid core comprising a loop structure having an inner surface that defines a through hole and an outer surface, and wherein the elastomeric portion is a monolithic body that fills the through hole and covers an entirety of the outer surface of the loop structure.

17. The personal care implement according to claim 12 wherein the first end portion of the first rigid portion comprises a first arcuate end surface that extends between the first and second tabs of the first rigid portion, and wherein the second end portion of the second rigid portion comprises a second arcuate end surface that extends between the first and second tabs of the second rigid portion.

18. A personal care implement comprising:

a rigid component comprising:

a first portion extending from a first end to a second end, the first portion forming a neck portion and a head portion of the oral care implement;

a second portion extending from a first end to a second end, the second portion forming a gripping portion of the oral care implement; and a core extending between the first end of the first portion and the first end of the second portion, the core comprising an inner surface that defines a through hole;

a resilient component comprising an elastomeric body that forms a thumb grip of the oral care implement, the elastomeric body comprising a peripheral surface; and wherein the core of the rigid component is embedded within the elastomeric body and the elastomeric body fills the through hole of the core; wherein the first end of the first portion of the rigid component comprises a first tab and a second tab, and wherein the first end of the second portion of the rigid component comprises a first tab and a second tab; and wherein each of the first and second tabs of each of the first and second portions of the rigid component terminates in a distal end that protrudes from the peripheral surface of the elastomeric body.

19. The personal care implement according to claim 18 wherein the first end of the first portion of the rigid component and the first end of the second portion of the rigid component have an arcuate shape.

* * * * *